United States Patent [19]

Sooter

[11] 4,292,165

[45] Sep. 29, 1981

[54] PROCESSING HIGH SULFUR COAL

[75] Inventor: Matthew C. Sooter, Ponca City, Okla.

[73] Assignee: Conoco, Inc., Ponca City, Okla.

[21] Appl. No.: 119,322

[22] Filed: Feb. 7, 1980

[51] Int. Cl.[3] ..... C10G 1/00; C10G 1/06; C10G 9/14

[52] U.S. Cl. ..... 208/8 LE; 208/131

[58] Field of Search ..... 208/8 LE, 131

[56] References Cited

U.S. PATENT DOCUMENTS

| | | | |
|---|---|---|---|
| 3,617,513 | 11/1971 | Wilson, Jr. | 208/8 LE |
| 3,717,570 | 2/1973 | Hochman | 208/8 LE |
| 3,726,785 | 4/1973 | Keller | 208/8 LE |
| 3,841,991 | 10/1974 | Cohen | 208/8 LE |
| 3,960,701 | 6/1976 | Schroeder | 208/8 LE |
| 3,966,584 | 6/1976 | Gray | 208/8 LE |
| 3,966,585 | 6/1976 | Gray | 208/8 LE |
| 3,997,422 | 12/1976 | Bull | 208/8 LE |
| 4,085,031 | 4/1978 | Walchuk | 208/8 LE |

*Primary Examiner*—T. M. Tufariello

*Attorney, Agent, or Firm*—Richard W. Collins

[57] ABSTRACT

Coal is fed to a liquefaction process, and a resulting slurry of ash, unconverted coal, and liquids is fed to a delayed coker. Distillates are hydrotreated and stored or recycled, and the coke is calcined at high temperature to reduce the sulfur content.

3 Claims, 1 Drawing Figure

PROCESSING HIGH SULFUR COAL

BACKGROUND OF THE INVENTION

This invention relates to processing of high sulfur coal, and more particularly to a process of producing low sulfur fuel, both liquid and solid, from a high sulfur coal.

Numerous processes are available for producing coke from coal. These processes, exemplified by U.S. Pat. Nos. 3,966,585 and 3,997,422, typically include a digestion step in which particulate coal is partially dissolved in the presence of a hydrogen-rich solvent, followed by a filtration or other solids removal step, finally followed by a delayed coking step. This type of process has been generally uneconomical heretofore because of the difficulties involved in removing finely divided solids from the dissolved coal and because of the severe process conditions required to effect significant sulfur removal.

Another approach is desired in U.S. Pat. No. 3,960,701, which describes a process of reacting crushed coal in a hydrogenation reactor followed by removal of an oil-solids product stream which is subsequently coked in a delayed coker. Solids removal prior to coking is indicated to be unnecesary, but the coal dissolution step in that process is conducted under severe pressure and temperature conditions.

There has been a long-standing need for a process which could treat a high sulfur coal to produce low sulfur liquid and solid products without the difficulties inherent in removing solids from the dissolved coal stream and without the necessity of a high temperature and pressure hydrogenation reactor as is required in the prior art. The process of this invention provides this capability.

SUMMARY OF THE INVENTION

According to the present invention, high sulfur coal is digested in the presence of hydrotreated gas oil from a delayed coker, and the digester effluent is processed in a delayed coker without any solids removal step to produce liquid and solid products. The liquid products can be desulfurized by conventional hydrotreating, and the solid coke product can be desulfurized by high temperature calcination. The process does not require desulfurization of the coker feed, and no filtration of solids from the dissolved coal stream is necesary. The elimination of these two difficult steps provides an improved process for obtaining low sulfur coke and low sulfur liquid fuel from high sulfur coal.

BRIEF DESCRIPTION OF THE DRAWING

The drawing is a schematic flow sheet illustrating the process of the invention.

DESCRIPTION OF THE PREFERRED EMBODIMENT

Figure 1:
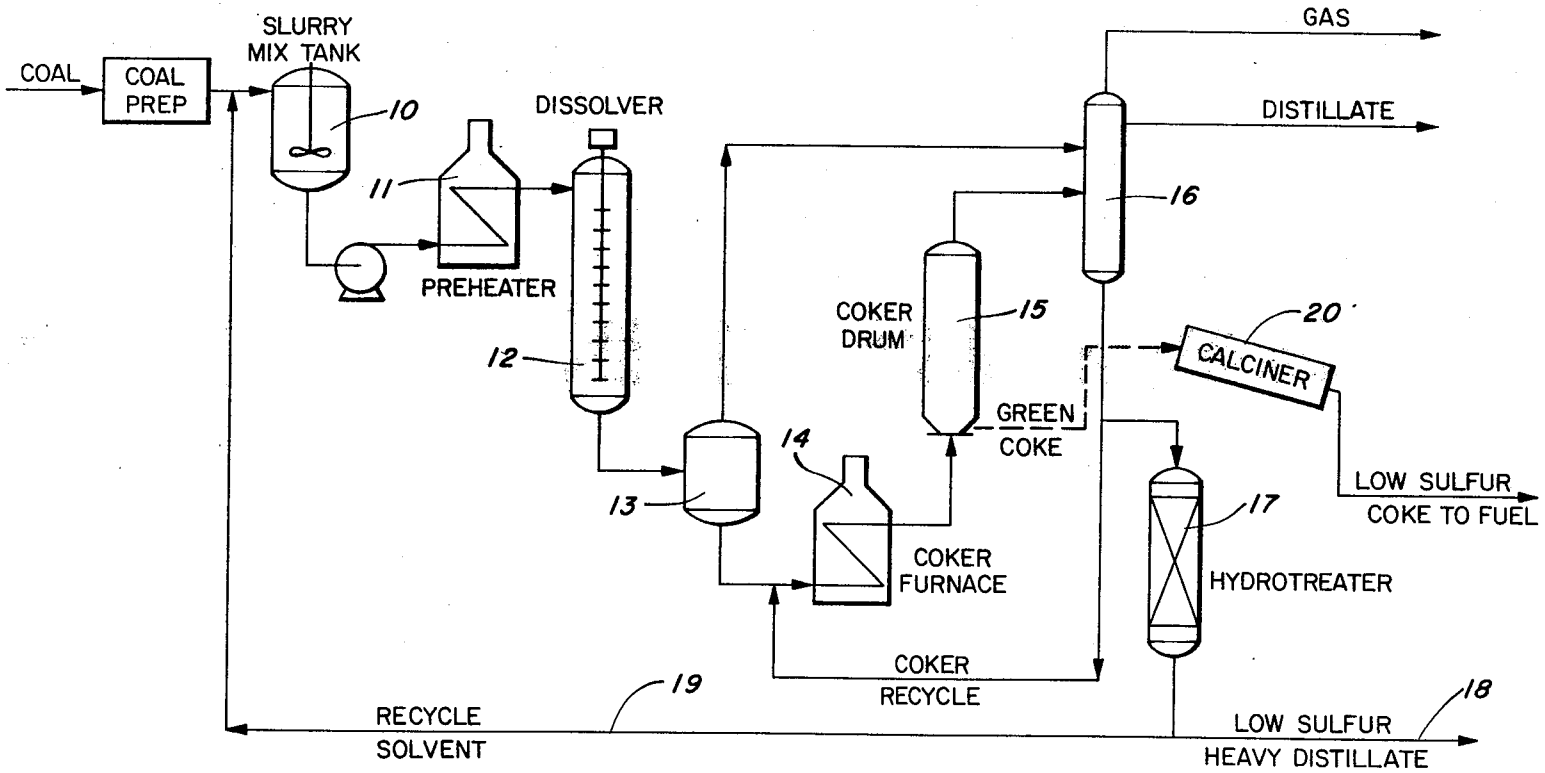

The process is applicable to any coal, but is particularly useful for coals having a sulfur content of 2 percent by weight or more. As used herein, the term "high sulfur coal" means a coal having a sulfur content of at least 2 percent by weight.

The process of the invention involves an initial coal preparation step in which coal is subjected to grinding and drying. The coal is then fed to a slurry mix tank 10 where it is slurried with a solvent. The slurry is then pumped to a preheater 11 where it is heated to a temperature of from 400° to 510° C. and then passed to dissolver 12 and maintained at a temperature of 390° to 505° C. and a pressure of 28 to 140 kg/cm$^2$ for a time of 0.2 to 2 hours. The amount of solvent utilized is generally from about ½ to 5 parts by weight for each part of coal. Preferably, about 2 parts by weight of solvent are used for each part by weight of coal. Typically, about 75 percent of the coal is dissolved in dissolver 12. The dissolved coal slurry is then passed to a pressure let-down vessel 13 where gases and some light distillates are removed. The remaining slurry is then passed directly, without any solids removal step, to a coker furnace 14 where it is heated to coking temperature, typically in the range of 450° to 525° C. The furnace effluent is then passed to coker drum 15 where delayed coke is produced. Overhead vapors from coke drum 15 pass to coke fractionator 16. Gases and light distillates from pressure let-down vessel 13 also can pass to fractionator 16. Gases and distillates are withdrawn from the upper sections of fractionator 16, and may be subjected to hydrotreating to reduce the sulfur content of the streams. Coker gas oil from the bottom of fractionator 16 is partially recycled to coker furnace 14 and partially hydrotreated in hydrotreater 17. Hydrotreated gas oil, low in sulfur content, is recovered through line 18, and part of the hydrotreated gas oil is returned via line 19 to slurry mix tank 10 for use as solvent in the process.

Delayed coke product, high in sulfur and ash content, is periodically removed from coker drum 15 and calcined in calciner 20 at a temperature of 1450° to 1600° C. to remove the volatile material and most of the sulfur therefrom. Calciner 20 may be a conventional rotary kiln, but for the higher temperature of the sulfur removing range, a vertical kiln is preferred.

The process of this invention produces a low sulfur solid fuel from high sulfur coal without the necessity of hydrotreating the heavy dissolved coal stream and without the necessity of filtering the slurry of dissolved coal, undissolved coal, ash and solvent.

I claim:

1. A process for treating high sulfur coal to produce liquids and delayed coke comprising:

(a) subjecting particulate coal having a sulfur content of at least 2 percent by weight to a coal liquefaction step where it is maintained at a temperature of 390° to 505° C. and a pressure of 28 to 140 kg/cm$^2$ for a time of 0.2 to 2 hours;

(b) separating gases and light ends produced in step (a) by pressure reduction and passing the remaining material from step (a) to a delayed coker after heating it in a coker furnace to 450° to 525° C.;

(c) recovering overhead vapors from the delayed coker and passing them to a fractionator where a gas-oil fraction is obtained;

(d) recycling a portion of the gas-oil fraction from the fractionator back to the delayed coker;

(e) hydrotreating another portion of the gas-oil fraction from the fractionator and returning at least part of the hydrotreated portion to the coal liquefaction step as recycle solvent;

(f) recovering solid delayed coke from said delayed coker; and (g) calcining said coke at a temperature of from 1450° to 1600° C. to produce a calcined coke having a reduced sulfur content.

2. The process of claim 1 wherein the gases and light ends separated in step (b) are passed to said fractionator.

3. The process of claim 1 wherein at least one stream from said fractionator other than the gas-oil stream is desulfurized.

* * * * *